US007976746B2

(12) United States Patent
Conservano

(10) Patent No.: US 7,976,746 B2
(45) Date of Patent: Jul. 12, 2011

(54) METHOD INSTALLING A MODULAR CONCRETE STAIR SYSTEM

(76) Inventor: Guy A. Conservano, Bellevue, WA (US)

( * ) Notice: Subject to any disclaimer, the term of this patent is extended or adjusted under 35 U.S.C. 154(b) by 442 days.

(21) Appl. No.: 11/728,217

(22) Filed: Mar. 26, 2007

(65) Prior Publication Data

US 2008/0236065 A1 Oct. 2, 2008

(51) Int. Cl.

| | |
|---|---|
| ***E04B 1/16*** | (2006.01) |
| *E04B 1/00* | (2006.01) |
| *E04F 11/00* | (2006.01) |
| *E04F 19/10* | (2006.01) |
| *B28B 7/22* | (2006.01) |
| *E04G 13/06* | (2006.01) |

(52) U.S. Cl. ..... 264/34; 264/35; 264/33; 52/185; 52/741.2; 249/14

(58) Field of Classification Search ..... 52/296, 52/741.2; 249/13

See application file for complete search history.

(56) References Cited

U.S. PATENT DOCUMENTS

| | | | | |
|---|---|---|---|---|
| 3,800,912 | A | 4/1974 | Ashworth | |
| 3,805,464 | A * | 4/1974 | Hanson | 52/190 |
| 4,157,742 | A | 6/1979 | Aanensen | |
| 4,168,764 | A | 9/1979 | Walters | |
| 4,244,154 | A * | 1/1981 | Weaver | 52/185 |
| 5,553,421 | A | 9/1996 | Stratford | |
| 5,632,124 | A | 5/1997 | Weingarten et al. | |
| 6,942,062 | B2 | 9/2005 | Schmid, Jr. | |

FOREIGN PATENT DOCUMENTS

JP 2002294959 A * 10/2002

OTHER PUBLICATIONS

Machine translation of JP 2002-294959 A.*

* cited by examiner

*Primary Examiner* — Christina Johnson
*Assistant Examiner* — Benjamin Schiffman
(74) *Attorney, Agent, or Firm* — William A. Jeckle; Lukins & Annis, P.S.

(57) ABSTRACT

A system for establishing modular concrete truss stairway during construction of a multi-floor building having concrete decks provides two pre-cast concrete stringers of plural stairsteps and a cast-in-place intermediate landing therebetween forming a stair truss structurally attached to and communicating between two vertically spaced adjacent concrete decks. The intermediate concrete landing is carried between the adjacent vertically spaced decks by adjacent end portions of the stringers. Internal reinforcement in the concrete decks, in each stringer and in the intermediate landing is operatively interconnected to provide structural rigidity to the stair truss. Concurrent pouring of concrete for the upper deck, the intermediate landing and a blocked out area defined in a lower deck structurally attaches the stair truss therebetween providing an operative stairway upon hardening of the concrete.

1 Claim, 5 Drawing Sheets

Figure 1:
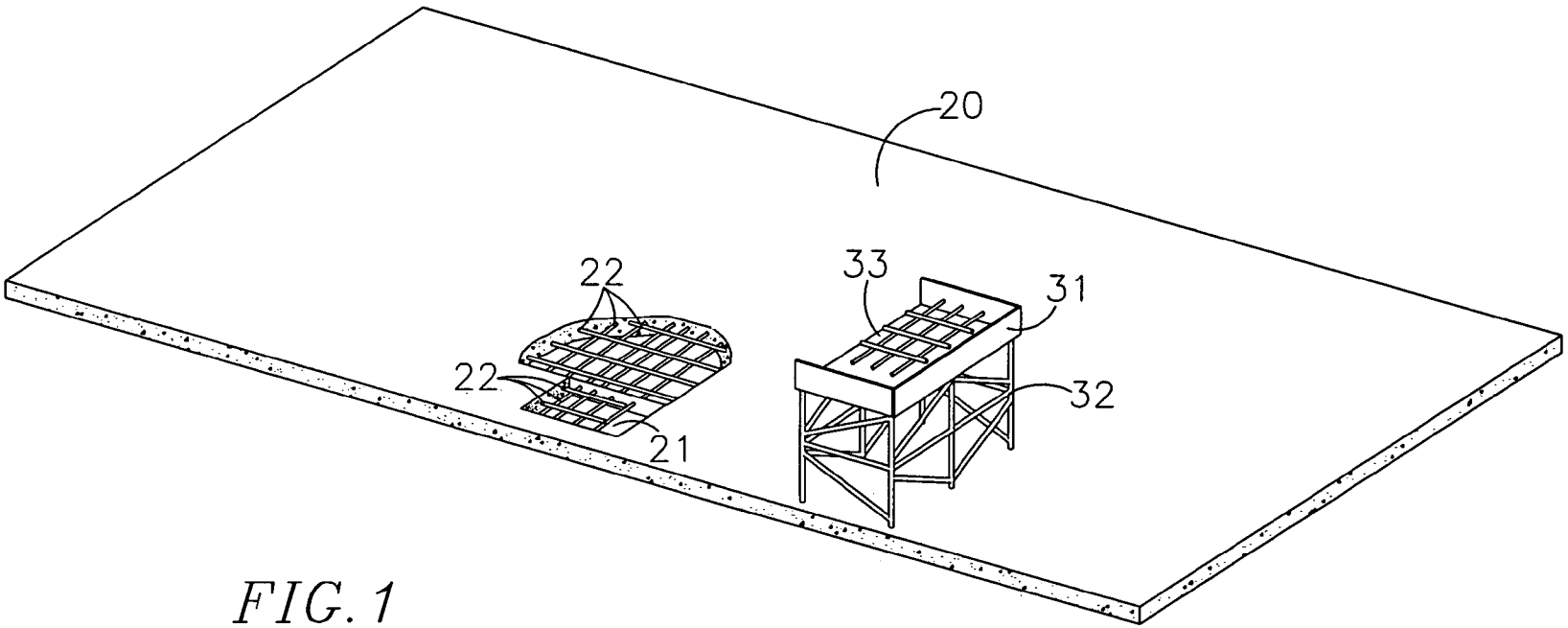

11
10a
16
33
34
14
12a
31
2a
10b
40
42
43
44
19
10
32
20
22
21

METHOD INSTALLING A MODULAR CONCRETE STAIR SYSTEM

II. BACKGROUND OF INVENTION

IIA. Related Applications

There are no applications related hereto heretofore filed in this or in any foreign country.

IIB. Field of Invention

This invention relates to stairways that are floor attached and self supporting.

IIC. Background and Description of Prior Art

All multi-floor buildings have means for persons to move between the floors and universally, at least one of these means is stairs. In construction of multi-floor buildings having concrete floors, (hereinafter called decks) it is necessary to form openings, (hereinafter called stairwells) where flights of stairs will ultimately be placed. Stairwells are formed during the pouring of the decks and typically remain open and empty until near completion of the construction project when flights of stairs are installed therein to communicate between the adjacent decks. Open and empty stairwells are a hazard to workers who might fall therethrough during the course of the construction.

Known prefabricated stair systems use stringers of metal or concrete stairs that extend linearly between adjacent decks. A bottom end portion of the stringer is fastened to a horizontal surface of a lower deck and an upper end portion rests upon the adjacent upper deck or upon a ledge or bracket proximate thereto. Anchoring the opposing end portions of the stringers to the adjacent decks transfers loads from the stringer to the decks. In some installations an intermediate landing, that is column supported above the lower deck, or suspended from the underside of the upper adjacent deck, is used to shorten the "horizontal run" of the flights of stairs while maintaining the same vertical rise. When an intermediate landing is used the upper end portion of one stringer of stairs and the lower end portion of a second stringer of stairs communicate with the intermediate landing in the same way a single stringer communicates between the adjacent lower and upper decks.

Prefabricated stair systems are commonly built offsite, are uniform, are pre-finished, and can only be installed after the supporting concrete decks are cured. Such stair systems are generally installed throughout the project at approximately the same time, typically close to the project's completion, or in stages of five to six flights at a time. Further, installation at a late stage in the project poses less risk of damage to the pre-finished flights of stairs by workers using the stairs during the project. Damaged stairs might need to be repaired or replaced, further escalating costs.

Prefabricated steel stringers typically utilize poured in place concrete treads that are not usable by workers until the treads are poured and have cured. Alternatively, temporary blocking must be installed in place of the concrete treads to provide a safe stepping surface for construction workers. Blocking unfortunately is time-consuming and expensive.

When prefabricated stringers are installed in a vertical channel type stairwell it is necessary to form vertically spaced ledges that extend outwardly from vertical walls and into the stairwell upon which the upper and lower end portions of the stringers are supported. The formation of such ledges precludes use of "slip forms" in the pouring of vertical channel concrete stairwells which can further increase project costs.

The availability of usable stairways, during the course of the project, would tend to increase efficiency, improve safety and reduce costs.

My modular concrete stair truss system overcomes various of the aforementioned drawbacks by providing a stair truss comprising two pre-cast concrete stringers of stairs that are each structurally joined to a concrete floor deck at vertically spaced end portions and carry a cast in place concrete intermediate landing at adjacent end portions. The stringers of stairs are installed concurrently with the pouring of the upper concrete deck and the concrete intermediate landing. As each subsequent upper deck and each subsequent intermediate landing is poured and cured, the flights of stairs are accessible and usable and the stairwells are filled eliminating a work site hazard. Because the stringers and intermediate landings are formed of concrete they are not susceptible to being easily damaged by workers during the course of the project.

My invention does not reside in any one of the identified features individually but rather in the synergistic combination of all of its structures, which give rise to the functions necessarily flowing therefrom as hereinafter specified and claimed.

III. SUMMARY

My modular concrete stair truss system provides two pre-cast concrete stringers of stairs and an intermediate landing communicating between vertically spaced adjacent decks of a multi-floor concrete deck building, each stringer and the intermediate landing having internal structural reinforcing, and interconnection of the structural reinforcing of each stringer to the internal structural reinforcement of the intermediate landing, and interconnection of the structural reinforcing of each stringer to internal structural reinforcement of the vertically spaced adjacent decks, and a method of installing the flights of stairs, the intermediate landing and the interconnections during the construction of the multi-floor concrete deck building.

In providing such an apparatus it is:

a principal object to provide a modular concrete stair system for installing flights of pre-cast concrete stairs concurrently with the casting of the concrete decks during construction of multi-floor concrete deck buildings.

a further object is to provide such a modular stair system forming a stair truss anchored to vertically spaced adjacent concrete decks and carrying an intermediate landing.

a further object is to provide such a modular stair system having pre-cast concrete stringers of stairs.

a further object is to provide such a modular stair system wherein the stair truss is installed, concurrently with the pouring of an upper concrete deck.

a further object is to provide such a modular stair system that may be installed without permanent vertical supports for the intermediate landing.

a further object is to provide such a modular stair system that is an architectural element adding aesthetic appeal to buildings.

a still further object is to provide such a modular stair system that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

IV. BRIEF DESCRIPTIONS OF DRAWINGS

In the accompanying drawings which form a part hereof and wherein like numbers refer to similar parts throughout:

FIG. 1 is a partial cutaway isometric view of a lower concrete deck showing a blocked out area with internal structural reinforcement of the lower deck extending into the blocked out area and scaffolding spacedly adjacent the blocked out area, supporting a concrete form for an intermediate landing.

Figures 2, 2A:
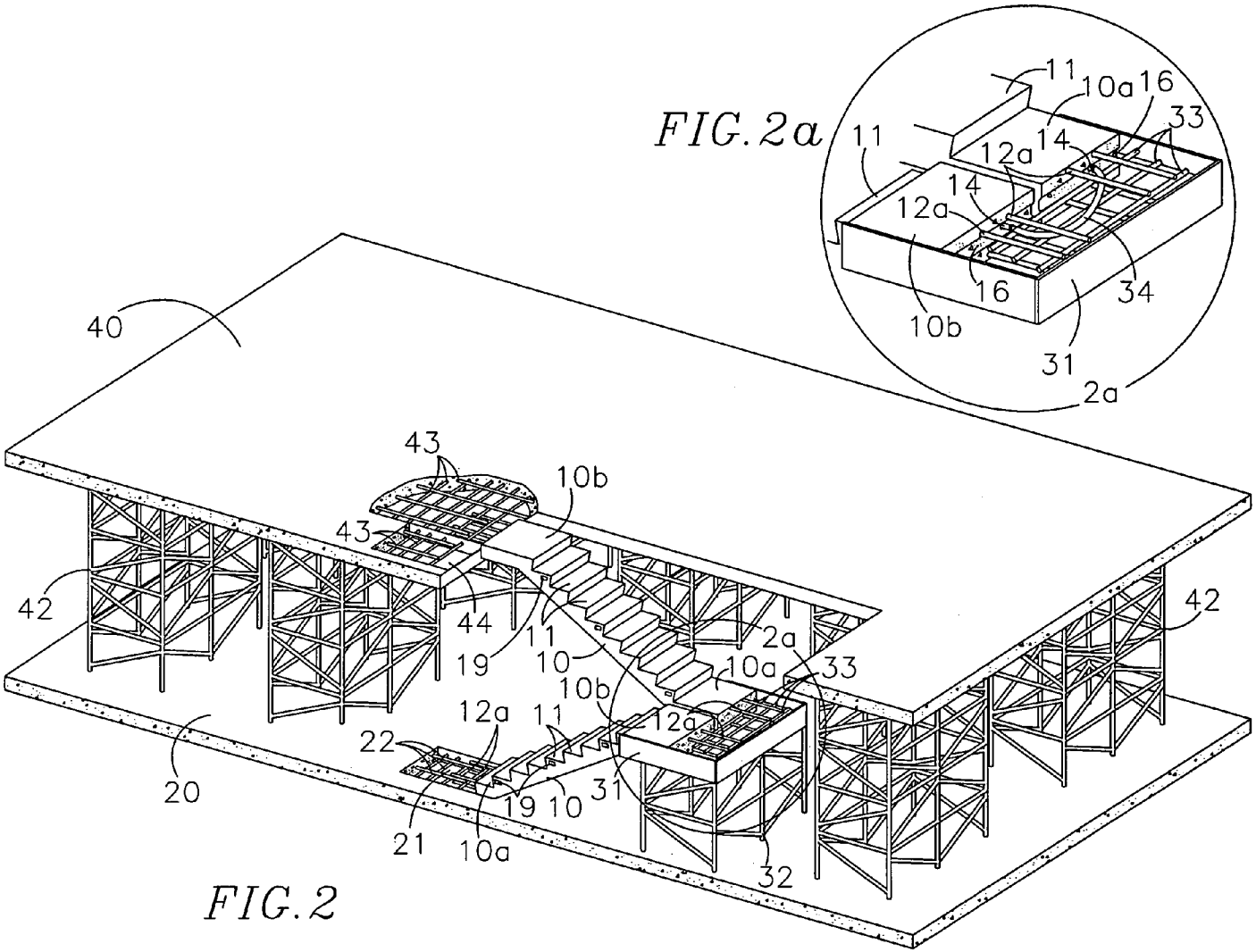

FIG. 2 is a partial cutaway isometric view of the lower concrete deck and a second concrete deck supported thereabove on scaffolds showing the internal structural reinforcement of the second concrete deck extending into a second blocked out area and showing one stringer of stairs communicating between the lower concrete deck and the intermediate landing form, and a second stringer of stairs communicating between the intermediate landing form and the second concrete deck.

FIG. 2*a* is an enlarged view of the intermediate landing form and adjacent end portions of the stringers of stairs of FIG. 2 showing external structural reinforcement extending from end portions of the stringers of stairs, the internal structural reinforcement of the intermediate landing, and a loop of tubular conduit interconnecting the conduit at the adjacent end portions of the stringers.

Figure 3:
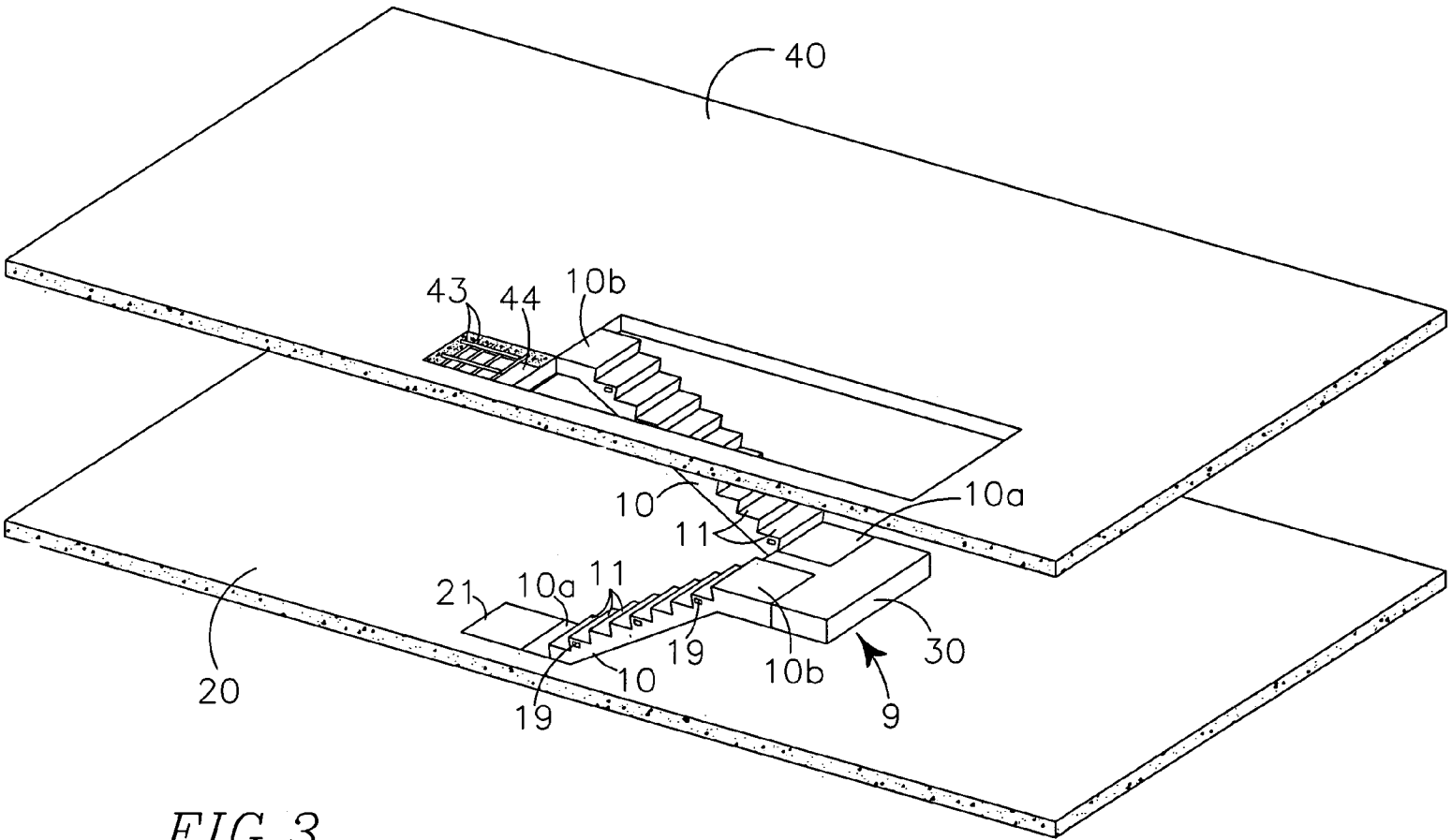

FIG. 3 is a partial cutaway isometric view showing a completed stairway truss and intermediate landing between the lower concrete deck and the second concrete deck and showing a second blocked out area in the second concrete deck for a next ascending stringer of stairs.

Figure 4:
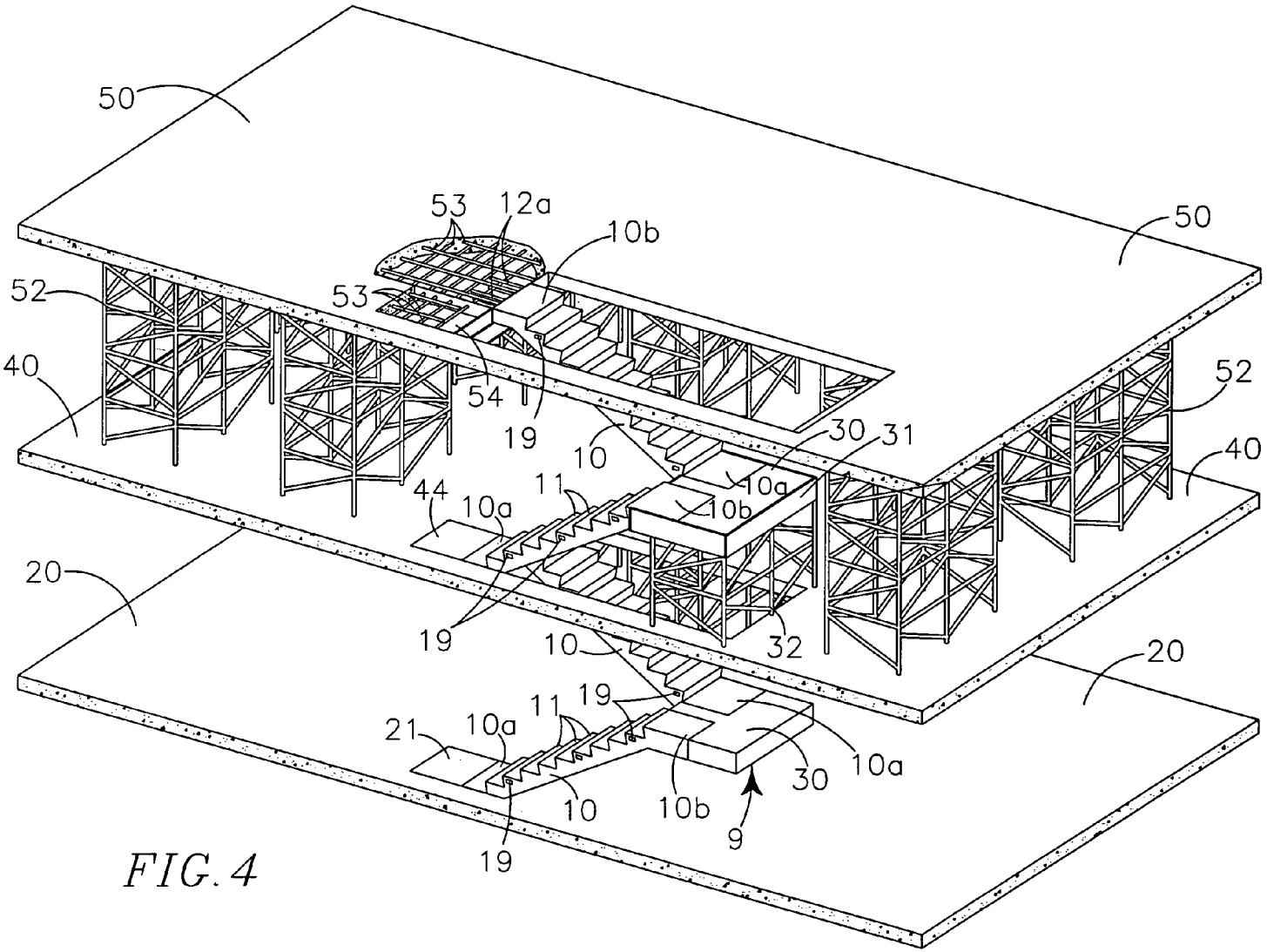

FIG. 4 is a partial cutaway isometric view showing a three deck structure with a completed stairway truss and intermediate landing between the lower concrete deck and the second concrete deck, scaffolds on the second concrete deck supporting a third concrete deck and a second intermediate landing form, the third concrete deck defining a third blocked out area, and a first stringer of stairs communicating between the second concrete deck and the second intermediate landing form and a second stringer of stairs communicating between the second intermediate landing form and the third concrete deck.

Figures 5, 5A, 5B:
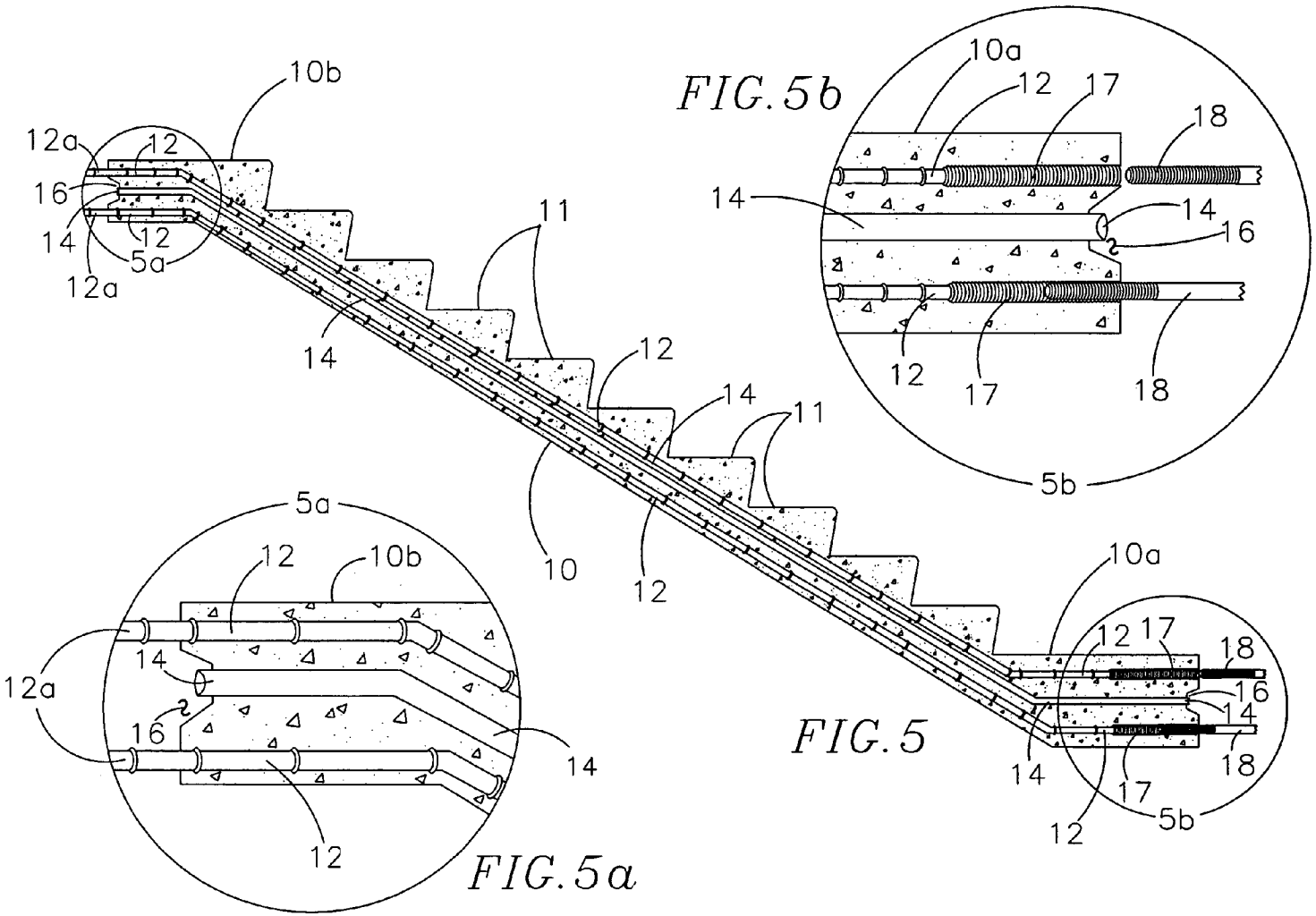

FIG. 5 is an enlarged orthographic elongate cross-section view of a stringer of stairs showing the internal structural reinforcement and conduit extending elongately therethrough and showing the keyways defined in each end portion.

FIG. 5*a* is an enlarged orthographic view of the upper end portion of the stringer of FIG. 5 showing the keyway, conduit end and structural reinforcement extending outwardly from the upper end portion forming the external structural reinforcement elements.

FIG. 5*b* is an enlarged orthographic view of the lower end portion of the stringer of FIG. 5 showing a second embodiment of the stringer connection means having two threaded couplers structurally attached to end portions of the structural reinforcement within the lower end portion of the stringer and threaded reinforcement rods communicating with the threaded couplers forming external structural reinforcement elements.

V. DESCRIPTION OF PREFERRED EMBODIMENT

As used herein, the term "flight" is a system of plural risers and treads that connect one deck to an adjacent deck. The term "stringer" is a continuous system of risers and treads spanning between a landing and a deck, or between a deck and a landing. The term "lower", its derivatives, and grammatical equivalents refers to the portion of my modular concrete stair truss having the least vertical height. The term "upper", its derivatives, and grammatical equivalents refers to the portion of my modular concrete stair truss having the greatest vertical height.

My modular concrete stair truss system generally provides two concrete stringers 10 each having plural stair steps 11, intermediate landing 30, structural interconnection of one end portion of each stringer 10 to the intermediate landing 30, structural interconnection of a first stringer 10 to a lower concrete deck 20, structural interconnection of the second stringer 10 to an adjacent upper concrete deck, and a method of installing the stair truss 9 in a multi-floor concrete deck building concurrently with the concrete decks.

As shown in FIG. 5, each stringer 10 is pre-cast of concrete, has a first lower end portion 10*a*, a second upper end portion 10*b* and defines a plurality of stair steps 11 therebetween. Internal structural reinforcement 12 of rebar and the like extends from the first lower end portion 10*a* to the second upper end portion 10*b* and is incorporated into the stringer 10 during forming and casting. In a first preferred embodiment the internal structural reinforcement 12 extends outwardly from the end portions 10*a*, 10*b* of each stringer 10 forming external structural reinforcement elements 12*a* that provide means for interconnecting the end portions 10*a*, 10*b* with internal structural reinforcement 22, 43, 53 of an adjoining concrete deck 20, 40, 50 and with the internal structural reinforcement 33 of the intermediate landing 30.

In a second embodiment, shown in FIG. 5*b*, threaded couplers 17 are carried at end portions of the internal structural reinforcement 12 of each stringer 10 and are similarly incorporated into the stringer 10 during forming and casting. Threaded reinforcement rods 18 threadably engage with the threaded couplers 17 to extend outwardly from the end portions 10*a*, 10*b* of the stringers 10 providing means for interconnecting the end portions 10*a*, 10*b* with the internal structural reinforcement 22, 43, 53 of an adjoining concrete deck 20, 40, 50 and the internal structural reinforcement 33 of the intermediate landing 30. Use of threaded couplers 17 and threaded reinforcement rods 18 makes transport of the stringers 10 easier, and simplifies installation because the threaded reinforcement rods 18 may be "woven" into the previously completed internal structural reinforcement 22, 43, 53 of the adjoining concrete decks 20, 40, 50 and the internal structural reinforcement 33 of the intermediate landing 30 which might otherwise be difficult.

A key-way 16 is defined in each end portion 10*a*, 10*b* of each stringer 10 so that semi-fluidic concrete may flow therein to add structural integrity to the interconnection of the stringer 10 to the adjoining concrete deck 20, 40, 50 and to the adjoining intermediate landing 30. Conduit 14 extends elongately through each stringer 10 from the first end portion 10*a* to the second end portion 10*b* defining an elongate channel to carry electrical cable, communications cable and the like. (not shown).

Handrail attachment brackets 19 on elongate side portions of the stringer 10 provide for attachment of hand rails. (not shown).

Having described the structure of my modular concrete stair truss system, its operation may be understood.

A first lower concrete deck 20 is formed with concrete forms (not shown) and internal structural reinforcement 22, such as rebar and welded wire mesh, is positioned within the forms. A blocked-out area 21 is also formed with concrete forms (not shown) and defined within the lower deck 20 at a position where the first lower end portion 10*a* of a stringer 10 will interconnect with the lower concrete deck 20. The blocked out area 21 is areally larger than the first lower end portion 10*a* of the stringer 10 and the internal structural reinforcement 22 extends into the blocked-out area 21. The lower concrete deck 20 is poured with concrete with the exception of the blocked out area 21 which remains empty of concrete. After the concrete forming a lower concrete deck 20 has hardened, the concrete forms may be removed and preparations are made for an adjacent upper second concrete deck 40.

The adjacent upper second concrete deck 40 is formed using scaffolding 42 positioned on the lower concrete deck 20 supporting concrete forms (not shown) for the second concrete deck 40. Internal structural reinforcement 43, such as rebar and welded wire mesh, is positioned within the concrete forms. A second deck blocked out area 44 is formed and defined in the second deck 40 with concrete forms at a position where the first lower end portion 10*a* of a next ascending stringer 10 will be anchored. Typically, the second blocked out area 44 will be adjacent the interconnection of the second upper end portion 10*b* of the stringer 10 communicating downwardly from the second deck 40 to the intermediate landing form 31. (FIG. 2). The second blocked out area 44 is areally larger than the first lower end portion 10*a* of the stringer 10 and the internal structural reinforcement 43 of the second deck 40 extends into the second blocked out area 44.

Scaffolding 32, supporting an intermediate landing form 31 is positioned on the lower concrete deck 20 spacedly adjacent the blocked out area 21 defined in the lower concrete deck 20. Internal structural reinforcement 33, such as rebar and welded wire mesh is positioned within the intermediate landing form 31.

As shown in FIG. 2, a first stringer 10 is positioned with the first lower end portion 10*a* communicating with the blocked-out area 21 defined in the lower deck 20 and the second upper end portion 10*b* communicating with the intermediate landing form 31. The external structural reinforcement elements 12*a* extending from the first lower end portion 10*a* and extending from the second upper end portion 10*b* are interconnected to the internal structural reinforcement 22 in the blocked out area 21 and to the internal structural reinforcement 33 of the intermediate landing 30 using means customary in the industry such as a wire, welding, interconnecting rebar, and the like. A second stringer 10 is positioned adjacent the previously positioned first stringer 10 so that the first lower end portion 10*a* communicates with the intermediate landing form 31, and the second upper end portion 10*b* communicates with the second concrete deck 40. The external structural reinforcement elements 12*a* extending from the second upper end portion 10*b* are interconnected with the internal structural reinforcement 43 of the second concrete deck 40 and the external structural reinforcement elements 12*a* extending from the first lower end portion 10*a* are interconnected with the internal structural reinforcement 33 of the intermediate landing 30 using means customary in the industry. If the stringers 10 have threaded couplers 17 and threaded reinforcement rod 18 assemblies (FIG. 5*b*), the stringers 10 may be positioned first and thereafter the threaded reinforcement rods 18 may be threadably interconnected with the threaded couplers 17 prior to interconnection with the internal structural reinforcement 22, 43, 53 of the decks 20, 40, 50 and the internal structural reinforcement 33 of the intermediate landing 30. Flexible conduit 34 communicates between and interconnects the conduit 14 at the adjacent end portions 10*a*, 10*b* of the stringers 10 at the intermediate landing 30 (FIG. 2*a*) and also at the decks 40, 50 (not shown) so that cabling for electrical and communications and the like may be threaded through the stair truss 9.

The second deck 40, the intermediate landing 30 and the blocked out area 21 defined in the lower concrete deck 20 are all poured with concrete in the same pour. The interconnection of the internal structural reinforcement 22, 43, 53 of the decks 20, 40, 50 to the external structural reinforcement elements 12a, 18 of the stringers 10, the interconnection of the internal structural reinforcement 33 of the intermediate landing 30 to the external structural reinforcement elements 12*a*, 18 of the stringers 10, as well as semi-fluidic concrete flowing into and filling the keyways 16 defined in the first and second end portions 10*a*, 10*b* of each stringer 10 establishes the structural integrity of the stair truss 9. After the concrete of the second deck 40, the intermediate landing 30 and the blocked out area 21 in the lower deck 20 has hardened, the scaffolding 32 supporting the intermediate landing form 31 and the scaffolding 42 supporting the concrete forms (not shown) for the second concrete deck 40 are removed and the stair truss 9 between the lower deck 20 and the second deck 40 is ready for use. (FIG. 3). The intermediate landing 30 "floats" because it is carried by the second upper end portion 10*a* of one stringer 10, and by the first lower end portion 10*b* of a second stringer 10. The process is repeated for a third deck (FIG. 4) and for subsequent upper decks as the subsequent upper decks are formed and poured.

The foregoing description of my invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

I claim:

1. A method of installing a modular concrete stair system in a multi-floor building having concrete decks as the building is constructed, the method comprising the steps:

forming a lower concrete deck defining a blocked out area, the lower concrete deck having internal structural reinforcement extending into the blocked out area, pouring the lower concrete deck with concrete and allowing the concrete cure;

supporting a form for an intermediate concrete landing spacedly above the lower concrete deck and spacedly adjacent the blocked out area;

supporting forms for an adjacent upper concrete deck spacedly above the lower concrete deck, the forms defining a stairwell and a second blocked out area;

adding internal structural reinforcement in the intermediate concrete landing form;

adding internal structural reinforcement in the forms for the adjacent upper concrete deck, the internal structural reinforcement for the adjacent upper concrete deck extending into the second blocked out area;

positioning a first stringer to communicate between the blocked out area defined in the lower concrete deck and the temporarily supported intermediate landing form and positioning a second stringer to communicate between the temporarily supported intermediate landing form and the adjacent upper concrete deck forms, each stringer being pre-formed of reinforced concrete and having, a first lower end portion, a second upper end portion and plural stair steps between the first lower end portion and the second upper end portion, internal structural reinforcement communicating between the first lower end portion and the second upper end portion, external structural reinforcement elements at the first lower end portion and the second upper end portion, and a keyway defined in the first lower end portion and in the second upper end portion into which semi-fluidic concrete flows before curing to provide structural rigidity to the stair system;

interconnecting the external structural reinforcement elements at the first lower end portion of the first stringer to the internal structural reinforcement of the lower concrete deck that extends into the blocked out area defined in the lower concrete deck and interconnecting the external structural reinforcement elements at the second upper end portion of the first stringer to the internal structural reinforcement of the intermediate landing within the intermediate concrete landing form;

interconnecting the external structural reinforcement elements at the first lower end portion of the second stringer to the internal structural reinforcement of intermediate landing within the intermediate concrete landing form and interconnecting the external structural reinforcement elements at the second upper end portion of the second stringer to the internal structural reinforcement of the adjacent upper concrete deck;

pouring the upper adjacent concrete deck, except a blocked out area for another stair system, the intermediate landing and the blocked out area defined in the lower concrete deck, in the same pour and finishing the concrete;

allowing the finished concrete in the blocked out area defined in the lower concrete deck, in the temporary intermediate landing form, and the adjacent upper concrete deck to harden; and removing the supports and form from the intermediate landing and removing the supports for the adjacent upper concrete deck so that the stair system is a unitary freestanding structure and the intermediate landing is supported in place by only the second upper end portion of the first stringer and the first lower end portion of the second stringer and the installed stair system is available for use during subsequent construction of the building.

* * * * *